United States Patent [19]

Leppälä

[11] 4,438,984

[45] Mar. 27, 1984

[54] DRILL STEEL GUIDING AND CENTRALIZING MECHANISM

[76] Inventor: Matti Leppälä, Teräksentie, 33960 Pirkkala 6, Finland

[21] Appl. No.: 349,086

[22] PCT Filed: Jun. 12, 1981

[86] PCT No.: PCT/FI81/00045

§ 371 Date: Feb. 12, 1982

§ 102(e) Date: Feb. 12, 1982

[87] PCT Pub. No.: WO82/00171

PCT Pub. Date: Jan. 21, 1982

[30] Foreign Application Priority Data

Jul. 2, 1980 [FI] Finland ..... 802116

[51] Int. Cl.[3] ..... B23Q 3/06; B25B 1/08; B25B 21/00; E21B 19/20

[52] U.S. Cl. ..... 308/3.9; 81/53 A; 81/54; 175/85; 269/34; 269/238

[58] Field of Search ..... 308/3.9; 24/263 DA, 24/263 D; 175/220, 85; 81/57.2, 57.33, 53 R, 53 A, 54 X; 173/163, 164; 269/34, 238

[56] References Cited

U.S. PATENT DOCUMENTS

| | | | |
|---|---|---|---|
| 1,317,049 | 9/1919 | Smith | 269/34 X |
| 1,954,920 | 4/1934 | Damerell | 269/34 X |
| 2,389,526 | 11/1945 | Maulding | 269/34 |
| 2,576,940 | 12/1951 | Iknayan et al. | 269/34 X |
| 4,076,337 | 2/1978 | Childress | 308/3.9 |

FOREIGN PATENT DOCUMENTS

| | | | |
|---|---|---|---|
| 2459516 | 7/1975 | Fed. Rep. of Germany . | |
| 2002412 | 10/1969 | France . | |
| 215154 | 9/1967 | Sweden . | |
| 636370 | 12/1978 | U.S.S.R. | 308/3.9 |

*Primary Examiner*—Stuart S. Levy
*Assistant Examiner*—Thomas R. Hannon
*Attorney, Agent, or Firm*—Hill, Van Santen, Steadman & Simpson

[57] ABSTRACT

A drill steel guiding and centralizing mechanism comprising a body (14) and a first and second jaw (1 and 6) connected to other ends of two-armed angled levers (2,3 and 7,8). The angled levers are turnably connected to the body (14) by joints (4 and 9) at the corner points between the arms (2 and 3; 7 and 8). The ends of the free arms (3 and 8) of the angled levers are connected to each other by a connecting road (11), the ends of which are connected to the ends of the arms (3 and 8) by swivel joints (12 and 13). The second angled lever (2,3) has an extension (16) which is affected by the power mechanism (15) substantially parallelly to the connecting rod (11). Thereby the jaws (1 and 6) can be opened and closed by the power mechanism (15) exactly centralized in relation to the drill steel.

3 Claims, 7 Drawing Figure

DRILL STEEL GUIDING AND CENTRALIZING MECHANISM

This invention relates to a drill steel guiding and centralizing mechanism which mechanism is of the type described in claim 1.

Swedish publication No. 353 762 discloses a drill steel guiding mechanism in which the guiding jaws are turnable around a common axis, and can be opened and closed by means of arms on both sides of the axis, which arms are provided with cams and wedge surfaces to take hold of the jaws. A disadvantage of this mechanism is that dirt and stone dust which goes between the wedge surfaces and between the cams and their counter surfaces cause wear and unaccurate centralizing. Because the jaws are closed with the aid of sharp wedge surfaces, a considerable part of the cylinder power is lost through friction, and part of the power affects in a wrong direction.

Swedish Pat. No. 215 154 discloses a drill steel guiding and centralizing mechanism in which device the jaws are movable by means of two cylinders operating opposite to each other. However, the cylinders may have different speeds of movement, e.g. due to different friction, whereby one of the jaws reaches the drill steel earlier and pushes the steel aside until the other jaw is met. Thus the centralizing is unaccurate. The mechanism is neither suitable for drill cuttings suction pipes of a large diameter. If the jaw travel increases, the centralizing accuracy will further decrease. These disadvantages of the known guiding and centralizing mechanisms cause among others the following additional disadvantages: Drilling speed decreases, the drilling direction becomes less accurate, the drilling machine is subjected to extra torsional loads and the life of the shank adapter is shorter. If an automatic drill steel handling mechanism is used, accurate centralizing of the drill steel is absolutely necessary. This requirement is not sufficiently fulfilled by the known drill steel guiding and centralizing mechanisms.

The object of this invention is to develop an improved drill steel guiding and centralizing mechanism which eliminates the disadvantages of the know guiding and centralizing mechanisms and makes the centralizing of the steel reliable and accurate.

This object is reached through the characteristics of the invention defined in claim 1.

Figure 1:
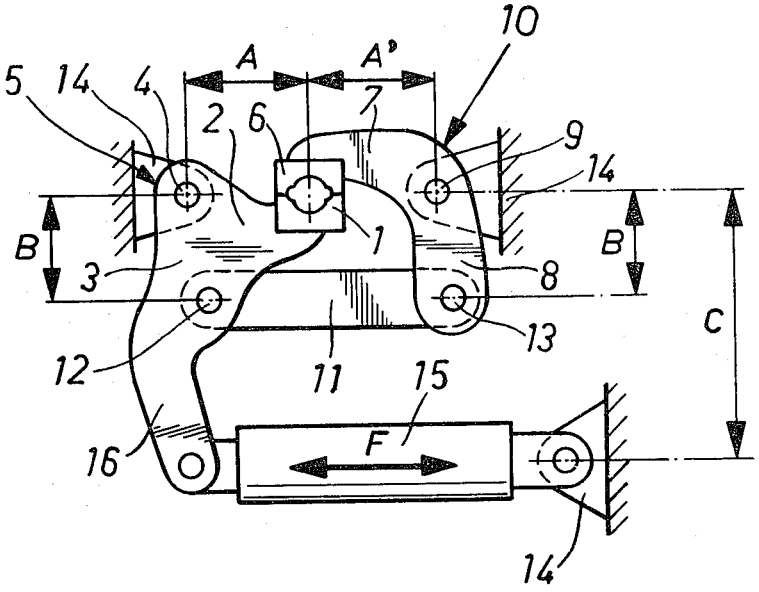
Figure 2:
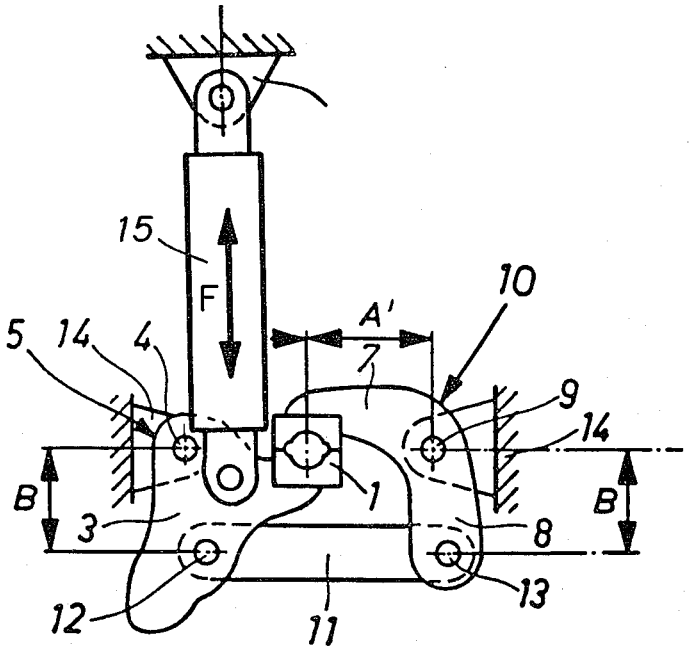
Figure 3:
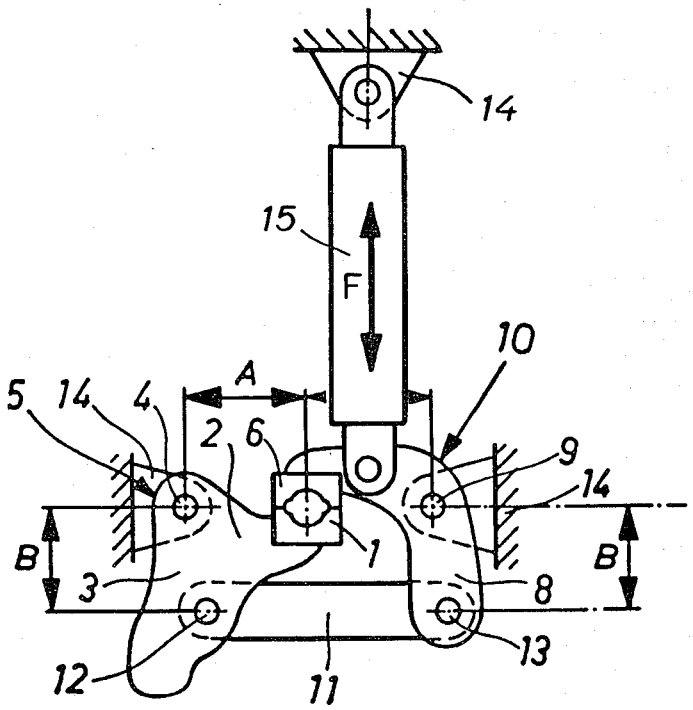
Figure 4:
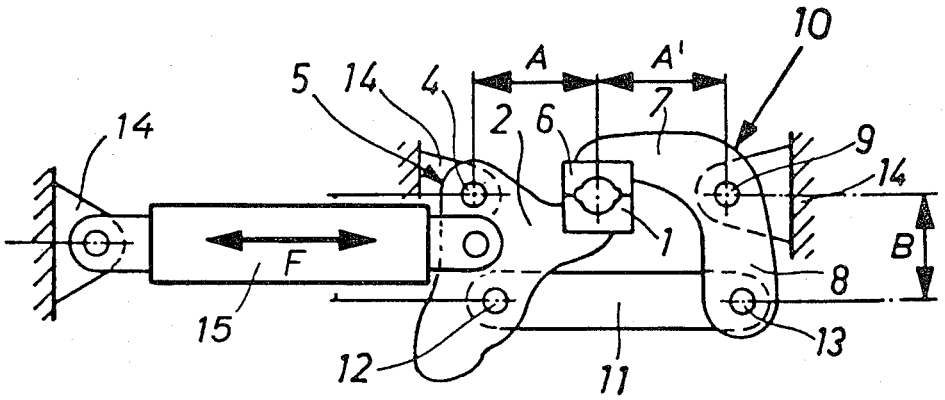
Figure 5:
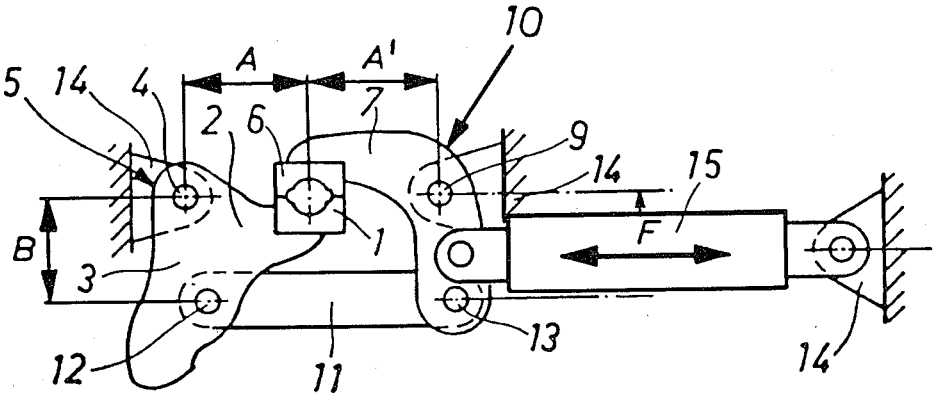
Figure 6:
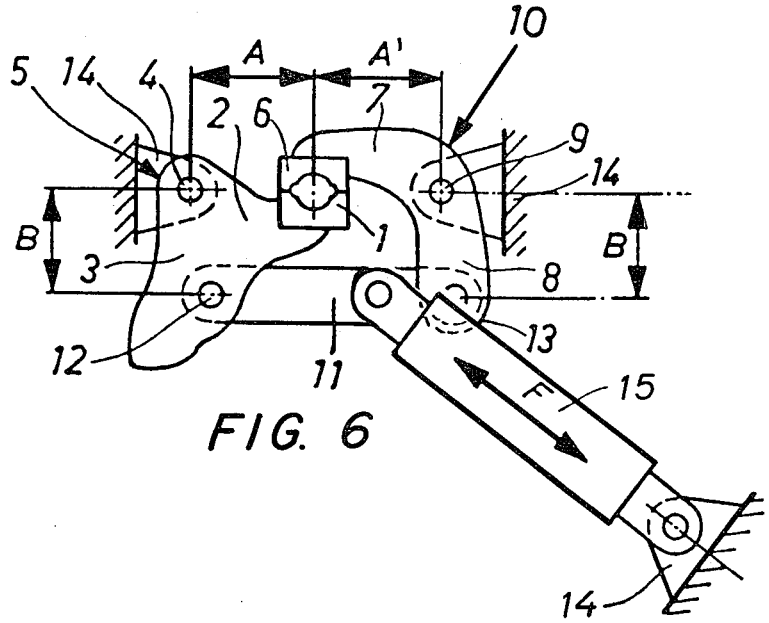
Figure 7:
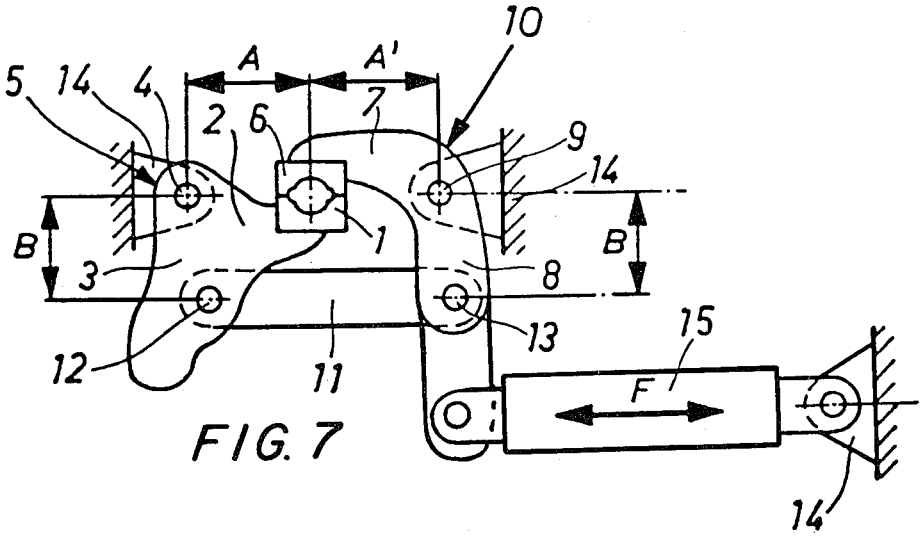

My invention is further described in more detail with reference to the following figure descriptions:

FIG. 1 illustrates a sideview of a drill steel guiding and centralizing mechanism with a power mechanism coupled with one of its lever arms; and FIGS. 2, 3, 4, 5, 6 and 7 illustrate side views of the mechanism as illustrated in FIG. 1 only with the power mechanism coupled in different ways with the various levers which form a part of the mechanism.

Numbers 1 and 6 in the drawing refer to the jaws for guiding and centralizing the drill steel; the jaws are shown in the closed position. Jaw 1 is connected to the first lever arm of the first angled lever 5. The angled lever 5 further comprises another lever arm 3 and an extension 16 therefor. The angled lever 5 is mounted on the body 14 by a swivel joint 4 which is between the lever arms 2 and 3.

The other jaw 6 is connected to the other angled lever 10 which also comprises two lever arms 7 and 8. Between these there is a swivel joint 9 by means of which the angled lever 10 is turnably mounted on the body 14. The radius of the holes of the jaws at the drill steel centre line can be made suitable e.g. for the fastening of the extension rods to the connecting socket. In this case the jaws are not closed against each other.

The lever arms 3 and 8 of the angled levers 5 and 10 are connected by a firm connecting rod 11 which is fastened to the arms 3 and 8 by swivel joints 12 and 13. The swivel joints 12 and 13 and the joints 4 and 9 are placed preferably in the corners of a parallelogram. The extension 16 of the lever arm 3 is connected to a piston cylinder device 15, the other end of which is in the body 14. The piston cylinder device can be coupled to affect any of the lever arms 2, 3, 7, 8 or the connecting rod 11 between the second lever arm 3 and the fourth lever arm 8. When the piston cylinder device 15 is lengthened, the jaws 1, 6 open symmetrically in relation to the drill rod centre line. If the length A of both lever arms 2 and 7 is equal, the travel of both jaws is the same. Thus the centralizing accuracy of the jaws remains good even if the jaws would not touch each other in the closed position, e.g. when taking hold of the connecting socket for extension rods by the jaws. Because the jaws open symmetrically, they are suitable also for mounting drill cuttings suction pipes. By adjusting mutually the dimensions A, B and C, the jaw travel and pressing power can be changed in relation to the stroke and the power of the piston cylinder device 15. E.g. when the relation A/B grows, the jaw travel increases even when the stroke of the cylinder remains unchanged. Thus the lever dimensions are defined by the available force F and the desired travel of the jaws 1,6.

I claim:

1. A drill steel guiding and centralizing mechanism comprising a body (14), a first jaw (1), a first lever arm (2) directly connected by said first jaw, a second lever arm (3) directly connected to the first lever arm away from the connection of the first jaw with the first lever, and an extension (16) for the second lever arm, a first swivel joint (4) connected between the first and the second lever arms and the body (14), around which joint the first angled lever (5) formed by the first and the second lever arms turns, and another jaw (6), cooperating with the first jaw in order to open and close the jaws, a third lever arm (7) directly connected to the second jaw, and a fourth lever arm (8) directly connected to the third lever arm away from the connection of the second jaw with the third lever arm, the body (14) between the third and the fourth lever arms, on which second joint (9) the angled lever (10) formed by the third and the fourth lever arms is swiveling, whereby the second lever arm (3) and the fourth lever arm (8) are on the same side in relation to the first and the second joints, and a power mechanism (15) to move the arms, the center of the jaws (1, 6) being positioned on a line connecting the joints (4, 9) when in a closed position of the jaws and that the jaws are movable away from and towards the line when the jaws are opened and closed, the improvement being that the second and fourth lever arms are connected through a firm connecting rod (11) that is connected to the second lever arm (3) by a third joint (12) and to the fourth lever arm (3) by a fourth joint (13) and that the power mechanism (15) to drive the arms being coupled to affect only one of the lever arms (2, 3, 7 or 8) or its extension, or the connecting rod (11) between the second (3) and fourth (8) lever arms, and the first (4), the second (9), the third (12) and the fourth (13) joints being corner points of a parallelogram.

2. A mechanism according to claim 1, the improvement being that the first (2) and the third (7) lever arms are equally long.

3. A mechanism according to claim 2, the improvement being that the power mechanism (15) driving the levers is directly connected to the extension (16) of the second (3) or fourth (8) lever arm.

* * * * *